United States Patent [19]

Maierson et al.

[11] Patent Number: 5,045,426

[45] Date of Patent: Sep. 3, 1991

[54] TONER ADHESION-ENHANCING COATING FOR SECURITY DOCUMENTS

[75] Inventors: Theodore Maierson; William H. Mowry, Jr., both of Dayton; Dianne M. Potter, Union, all of Ohio

[73] Assignee: The Standard Register Company, Dayton, Ohio

[21] Appl. No.: 369,295

[22] Filed: Aug. 21, 1989

[51] Int. Cl.[5] ..... G03G 13/10

[52] U.S. Cl. ..... 430/126; 427/121; 355/279

[58] Field of Search ..... 430/126; 428/211, 512; 427/121

[56] References Cited

U.S. PATENT DOCUMENTS

| | | | |
|---|---|---|---|
| 2,855,324 | 10/1958 | Van Dorn | 117/25 |
| 3,130,064 | 4/1964 | Insalaco | 117/17.5 |
| 3,535,112 | 10/1970 | Dolce et al. | 430/126 |
| 3,539,340 | 11/1970 | Dolce et al. | 430/126 |
| 3,539,341 | 11/1970 | Dolce et al. | 430/126 |
| 3,854,942 | 12/1974 | Akman | 355/4 |
| 3,950,595 | 4/1976 | Tanaka et al. . | |
| 3,958,990 | 5/1976 | Parent | 427/16 |
| 4,071,362 | 1/1978 | Takenaka et al. | 427/25 |
| 4,104,066 | 8/1978 | Williams | 427/19 |
| 4,132,882 | 2/1979 | Endo et al. . | |
| 4,254,201 | 3/1981 | Sawai et al. | 430/126 |
| 4,337,305 | 6/1982 | Sahyun et al. | 430/11 |
| 4,499,168 | 2/1985 | Mitsuhashi | 430/99 |
| 4,510,225 | 4/1985 | Kuehnle | 430/126 |
| 4,778,711 | 10/1988 | Hosomura et al. | 428/211 |
| 4,863,783 | 9/1989 | Milton | 428/207 |
| 4,908,240 | 3/1990 | Auhorn | 428/512 |
| 4,935,288 | 6/1990 | Honaker et al. | 428/207 |

OTHER PUBLICATIONS

"New Papers for New Printers", Chemtech (1986), pp. 304–310.

*Primary Examiner*—John Goodrow

*Attorney, Agent, or Firm*—Killworth, Gottman, Hagan & Schaeff

[57] ABSTRACT

A coated cellulosic web product and coating composition which provides enhanced toner adhesion for documents printed using noncontact printing devices such as laser printers is provided. The toner adhesion enhancing coated cellulosic product includes a cellulosic web having first and second major surfaces with at least one of the major surfaces having coated thereon a polymeric toner adhesion-enhancing composition comprising a generally transparent copolymer of styrene and acrylic acid having a glass transition temperature of between about −16 and 22 degrees C and from about 1 to about 5% by weight zinc as a cross-linking agent for said copolymer. The web may be either continuous or in sheet form. The toner adhesion-enhancing composition may also optionally include a coloring agent and a plasticizing agent.

25 Claims, 1 Drawing Sheet

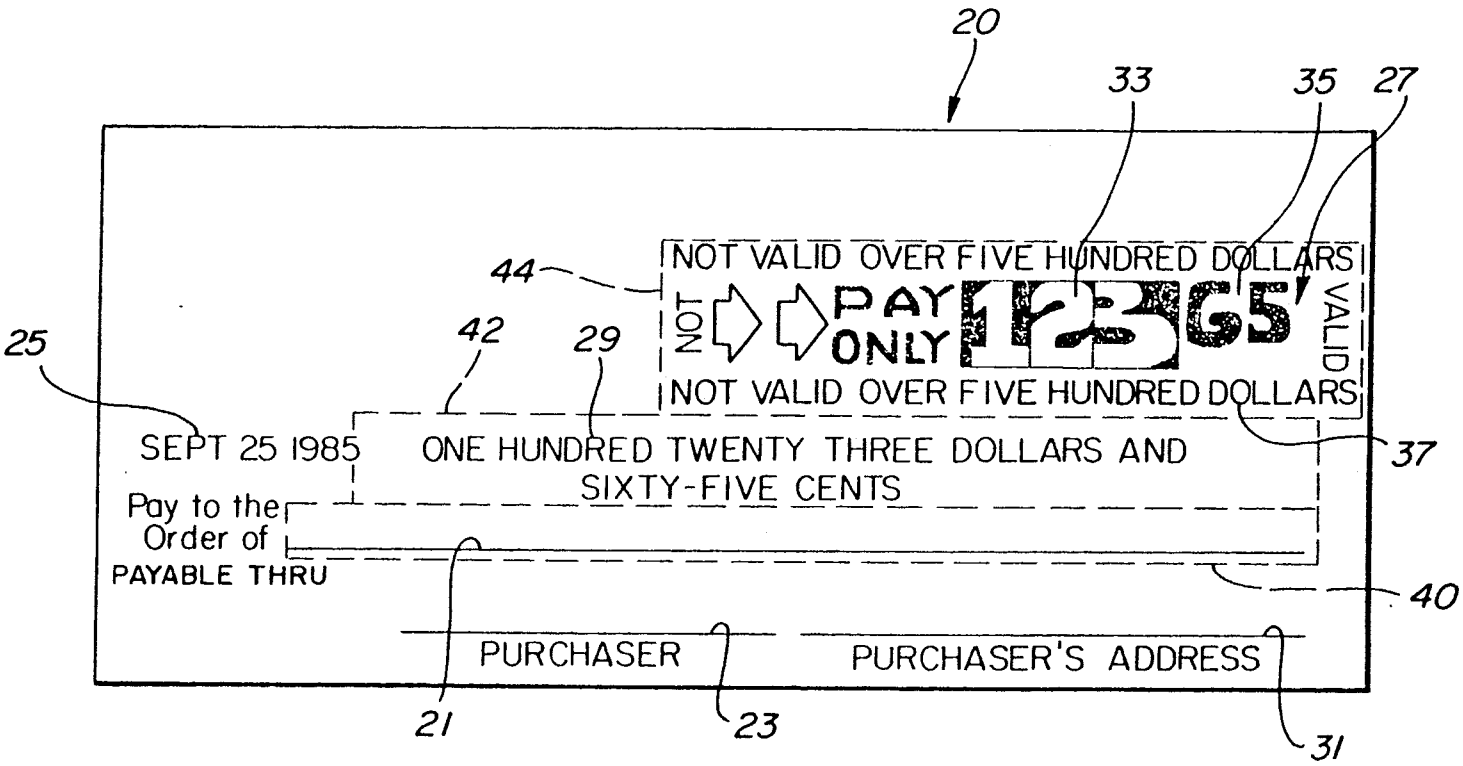
20
27
35
33
37
40
31
23
21
25
29
42
44
NOT VALID OVER FIVE HUNDRED DOLLARS
VALID
NOT
PAY
ONLY
NOT VALID OVER FIVE HUNDRED DOLLARS
ONE HUNDRED TWENTY THREE DOLLARS AND
SIXTY-FIVE CENTS
PURCHASER'S ADDRESS
PURCHASER
SEPT 25 1985
Pay to the
Order of
PAYABLE THRU

TONER ADHESION-ENHANCING COATING FOR SECURITY DOCUMENTS

BACKGROUND OF THE INVENTION

This invention relates to an adhesion enhancing coating and coated paper for heat and pressure fused toner particles, and more particularly to a coating and coated paper for use on security or business documents produced using noncontact printing devices such as laser or xerographic printers which provides improved adhesion of the toner particles to the printed security or business document produced.

Business forms, labels, bar codes, and security documents are printed on a wide variety of commercial printing devices. Traditional mechanical impact printers have been used in the past for many of these applications, especially in the imprinting of information on security documents such as checks. The mechanical impact produced by the printers, whether based on formed characters or dot matrix, generally provides information which adheres quite well to the underlying paper document. However, such mechanical impact printers have limited speed, high noise levels, and high costs for parts and maintenance.

With the advance of microcomputer technology, a number of faster printing methods have been developed to take advantage of the high-speed printing output which is now possible. Recently developed nonimpact printers are fast, quiet, and potentially more reliable because of fewer moving parts. Laser printers are one class of these newer nonimpact printers. Such printers operate by turning on and off a computer-controlled laser beam of light in a specific pattern onto an image cylinder or drum to form a latent image of positive and negative static charges.

As the image cylinder is rotated, toner particles from a toner cartridge are deposited on the image areas on the cylinder and held there by the static charges. As the image cylinder continues to rotate, the now visible toner image on the cylinder is then transferred to a paper web which has been statically charged to attract the toner particles and has the correct level of conductivity required. A corona wire positioned adjacent the image cylinder then erases the cylinder so that a new cycle may begin.

Typically, the toner image on the paper is then fused by passing the paper through a pair of rolls which apply both heat and pressure to the paper. This fusing by the application of heat and pressure is designed to bond the toner particles permanently to the paper. Descriptions of noncontact printers such as laser printers, the toners used therein, and the papers used for printing on them are known. See, for example, "New Papers for New Printers", Chemtech (1986), the disclosure of which is hereby incorporated by reference.

While laser printing is fast and quiet, the process has had significant limitations which have prevented its wide use in printing certain types of documents such as checks, other security documents, labels, and documents having bar code information thereon. These limitations include the inability to achieve satisfactory toner bonding on a large variety of paper products used to make such documents. For example, documents such as checks which contain not only payee and amount information but also MICR coding for automated handling must be able to withstand multiple handling and sorting cycles in high speed automated machinery. If the toner containing information such as MICR or bar coding on the document flakes off or is otherwise removed during such operations, the document will be rejected from the system and will have to be handled manually.

Additionally, because of the lack of strong adherence of toner to paper, documents printed using laser printers are subject to deliberate alteration by counterfeiters, forgers, and the like. For example, check amounts and/or payee information may be readily scraped off and new amounts substituted by the unscrupulous. While it may be possible to adjust the heat and/or pressure fusing steps which adhere the toner particles to paper as the information is printed, care must be taken not to overheat or melt the toner particles or scorch the paper stock.

Still further, papers used in laser printing systems must have a very narrow range of volume and surface resistivities to insure that the toner image is properly transferred from the image cylinder or drum. Such papers are also required to have a relatively high degree of surface smoothness and flatness, a specific range of moisture contents, and resistance to curl. Fabrication of special papers to have these characteristics increases the costs of such papers and their use.

Attempts have been made previously in the art of xerography to improve toner adhesion to substrates. Some of these efforts have been directed to the modification of the toner particles themselves. For example, Mitsuhashi, U.S. Pat. No. 4,499,168, added both a vinyl-containing polymer as well as polyethylene to toner particles to improve image fixing by the fuser rolls in a xerographic process. Sawai et al, U.S. Pat. No. 4,254,201, taught the use of a pressure sensitive adhesive added to the toner particles which was exuded under heat and pressure by the fuser rolls to fix the toner to a substrate.

A number of prior art workers have used various coatings on substrates in an attempt to improve toner adhesion. For example, Kuehnle, U.S. Pat. No. 4,510,225, coated a layer of a thermoplastic polymer on a substrate which was then preheated so that the toner particles would become embedded in that layer. Van Dorn, U.S. Pat. No. 2,855,324, taught the use of resin-coated paper to improve toner transfer, while Insalaco, U.S. Pat. No. 3,130,064, taught dipping a record card in a toluene solution containing a styrene-n-butyl acrylate copolymer in an attempt to improve toner adhesion.

A problem which is encountered with the use of coatings on papers is that the coatings are subjected to heat and pressure in the fuser rolls and may delaminate from the paper onto the hot fuser rolls, fouling the rolls or other parts of the printer into which they come into contact. Moreover, if the particular coating changes the surface properties of the paper or alters the paper's handling characteristics, further problems may result in the feeding, handling, printing, and ejection of the paper from the printer. For example, for those coatings which are applied from a solution which penetrates the paper surface, handling characteristics of the resulting coated paper may be altered.

Accordingly, there remains a need in the art for a paper product which provides enhanced toner adhesion for noncontact printed products without the drawbacks of prior art products.

SUMMARY OF THE INVENTION

The present invention meets that need by providing a coated cellulosic web product and coating composition which provides enhanced toner adhesion for documents printed using noncontact printing devices such as laser printers. In accordance with one embodiment of the invention, a toner adhesion enhancing coated cellulosic product is provided which comprises a cellulosic web having first and second major surfaces with at least one of the major surfaces having coated thereon a polymeric toner adhesion-enhancing composition comprising a generally transparent copolymer of styrene and acrylic acid having a glass transition temperature of between about −16 and 22 degrees C. and from about 1 to about 5% by weight zinc as a cross-linking agent for said copolymer. The web may be either continuous or in sheet form.

The toner adhesion-enhancing composition may also optionally include a coloring agent. The coloring agent may be useful to provide enhanced evidence of any erasure attempts on those areas of the security document where the polymeric toner adhesion-enhancing composition has been coated. Preferably, the coloring agent is a pigment or an encapsulated dye which imparts a color to the coating but does not interfere with its transparency. The dye is preferably contained in a plurality of microcapsules having a diameter of less than about 5.0 micrometers, and most preferably between about 2.0 to about 2.5 micrometers. The coating further optionally includes a plasticizer which enhances the flexibility of the coating. Preferably, the plasticizer is one which can be dispersed in an aqueous solution, such as dibutyl phthalate. The plasticizer is added in an amount of less than about 10% by weight of the toner adhesion-enhancing composition (solid basis).

The toner adhesion-enhancing composition may be applied over the entire surface(s) of the web or may, optionally, be applied only to certain selected portions of the web. Examples of selected portions of the web which may be coated include areas on a security document such as a check in which MICR codes, payee, or amount information is to be printed. The toner adhesion-enhancing composition is preferably applied to the web at a coating weight of between about 0.3 and 1.0 lb/ream, and most preferably about 0.6 lb/ream (17×22, 500 sheet ream).

In a preferred embodiment of the invention, the toner adhesion-enhancing coating composition is applied to a security or other business document such as a money order, check, bill of lading, or account statement to render the document more resistant to normal handling operations as well as to be more resistant to intentional alterations. In accordance with another aspect of the invention, a security document having enhanced toner adhesion characteristics for printing with a noncontact printing device is provided which comprises a cellulosic web having first and second major surfaces with at least one of the major surfaces having coated thereon a polymeric toner adhesion-enhancing composition comprising a copolymer of styrene and acrylic acid having a glass transition temperature of between about −16 and 22 degrees C. and from about 1 to about 5% by weight zinc as a cross-linking agent for said copolymer.

Again, the toner adhesion-enhancing composition may optionally include a coloring agent such as a pigment or encapsulated dye to provide enhanced evidence of any attempted erasures or alterations. The toner adhesion-enhancing composition also may be coated over the entire surface(s) of the document or coated only on selected portions of the document where MICR code, payee, and/or amount information is printed. As described above, the toner adhesion-enhancing composition is applied at a coating weight of between about 0.3 and 1.0 lb/ream, and most preferably about 0.6 lb/ream.

The present invention also provides a method of printing a document using a noncontact printing device comprising the steps of forming a latent image of the document on an imaging drum, applying a toner to the latent image, transferring the latent image to a surface of a cellulosic web product having coated thereon a polymeric toner adhesion-enhancing composition comprising a copolymer of styrene and acrylic acid having a glass transition temperature of between about −16 and 22 degrees C., and from about 1 to about 5% by weight zinc as a cross-linking agent for said copolymer, and thereafter fusing the toner to the surface of the cellulosic product by the application of heat and pressure.

The toner adhesion-enhancing composition preferably is applied to the cellulosic web as an aqueous dispersion. By dispersion, it is meant that the copolymer exists as discrete particles suspended in the aqueous media. The aqueous dispersion may also optionally contain a coloring agent such as a pigment or encapsulated dye and a plasticizer. The application of the toner adhesion-enhancing composition to the cellulosic web may be only on selected portions of the cellulosic web where payee and/or amount information is printed. The toner adhesion-enhancing composition is preferably applied at a coating weight of between about 0.3 and 1.0 lb/ream, and most preferably about 0.6 lb/ream.

The toner adhesion-enhancing coated cellulosic web product and composition of the present invention have been found to be of particular utility in connection with noncontact printing devices such as laser and xerographic printers which fix the toner to the paper web through the use of heat and pressure. The invention provides printed documents which can withstand the normal automated handling operations commonly encountered by security and business documents such as checks, other MICR coded documents, bar coded documents, and the like without the flaking off or removal of the toner from the document.

Further, documents printed on substrates utilizing the coating composition of the present invention have been found to have increased resistance to intentional defacement or alteration of printed information. Additionally, the coating is substantially transparent and does not alter the surface properties or handling characteristics of the paper web, and the composition remains secured to the paper web during fusing of the toner image.

Accordingly, it is an object of the present invention to provide a coated cellulosic web product and coating composition which provides enhanced toner adhesion for documents printed using noncontact printing devices such as laser printers. This, and other objects and advantages of the present invention, will become apparent from the following detailed description, the accompanying drawings, and the appended claims.

BRIEF DESCRIPTION OF THE DRAWINGS

The single drawing FIG. 1 depicts a plan view of a security document illustrating the positioning of the toner adhesion-enhancing coating of the present invention on the document.

DETAILED DESCRIPTION OF THE PREFERRED EMBODIMENT

With the availability of high speed noncontact printing devices, the capability to use such printing devices for high volume printing of security documents, checks, bar coded documents, and the like is desirable. However, heretofore, the toner particles deposited onto printed documents and fixed there by the noncontact printing devices has been less than satisfactory for a number of reasons. In particular, the toner images forming MICR codes or bar codes must adhere sufficiently to the document that the codes may be read by automated equipment through several handling cycles. Thus, the images must remain dense, and the edges of the characters well-defined in order that optical machinery can correctly read the information.

Additionally, information printed on such documents must be resistant to defacement and/or intentional alteration. Further, the document, and in particular the surface of the document which is to be printed must also possess a number of attributes to render it suitable for use with nonimpact printers. Initially, the document must be capable of being printed first by conventional offset and/or flexographic printing presses to contain repetitive background information. Further, the document and surface must be compatible with a number of other business forms related operations including perforating, slitting, gluing, punching, and the like.

The document must have the correct range of moisture and electrical properties which render it receptive to the toners used by noncontact printing devices. The document surface must also be receptive to being printed upon by a variety of other printing implements including typewriters, pens, and pencils. Finally, the document surface must be able to resist degradation resulting from rough handling, heat, and/or light exposure experienced during printing, storage, and use. The coated cellulosic web product and coating composition of the present invention meets all of those requirements while enhancing the adhesion of toner to the surfaces of these products. In its preferred form, the coated cellulosic product includes a polymeric toner adhesion-enhancing composition comprising a generally transparent copolymer of styrene and acrylic acid having a glass transition temperature of between about −16 and 22 degrees C. and from about 1 to about 5% by weight zinc as a cross-linking agent for the copolymer.

The toner adhesion-enhancing composition is preferably applied to the web at a coating weight of between about 0.3 and 1.0 lb/ream, and most preferably about 0.6 lb/ream (17×22, 500 sheet ream). The coating weight applied should be enough to insure 100% coverage and yet not an excessive amount which could lead to transfer of portions of the coating to the fuser rolls.

The preferred copolymers of styrene and acrylic acid are available from S. C. Johnson and Sons, Inc. under the trademark of Joncryl resins. Other suitable copolymers of styrene and acrylic acid are available from ICI Resins, Inc. under the trademark of Neocryl resins. A range of copolymers is available having glass transition temperatures. The preferred glass transition temperature range for use in the present invention is between about −16 and 22 degrees C. In a preferred embodiment of the invention, the coating composition comprises Joncryl 77 resin, available as a copolymer dispersion or emulsion having from 40-50% polymer solids and a glass transition temperature of 21 degrees C.

Copolymers having glass transition temperatures near the upper end of the preferred range are desirable for use in noncontact printing systems where high thermal fusing temperatures (>300 degrees F.) are encountered such as in an IBM 3800 laser printer. Copolymers having glass transition temperatures nearer the lower end of the preferred range are suitable for use in noncontact printers having lower thermal fusing temperatures. Blends of copolymers may be used to tailor the glass transition temperature of the composition to optimize it for a particular printing device and fusing temperature.

The toner adhesion-enhancing coating of the present invention also contains from about 1 to about 5% by weight, based on copolymer solids, of zinc as a cross-linking agent for the copolymer. The zinc is preferably added to the aqueous copolymer dispersion in the form of a zinc oxide ammonia complex in an aqueous alkaline solution. During mixing of the dispersion, an association of the copolymer and zinc occurs. Final cross-linking is believed to occur when all free water and ammonia leave the coating after it is dried.

The hardness of the toner adhesion-enhancing coating can be adjusted by varying the zinc content of the dispersion. It has been found that bonding of the toner to the coated substrate is best if a moderately cross-linked copolymer is employed. Such moderate cross-linking is brought about through the use of a zinc concentration of about 3-8% by weight in the aqueous dispersion. On a dry solids basis, this is about 1-5% by weight zinc. This results in a tough film coating which does not offset onto fuser rolls during operation.

While the toner adhesion-enhancing coating of the present invention is essentially colorless, it is within the scope of the invention to provide coloring agents to the coating which will provide a colored surface to the coated cellulosic web. Alternatively, the web itself may be colored. The coloring agent may be useful to provide enhanced evidence of any erasure attempts on those areas of the security document where the polymeric toner adhesion-enhancing composition has been coated. Preferably, the coloring agent is a pigment or encapsulated dye which imparts a color to the coating but does not interfere with its transparency.

The use of an encapsulated dye is especially preferred as encapsulation of the dye prevents its penetration into the substrate. This phenomenon provides a sharp line of demarcation between the colored coating and the substrate at the interface thereof which is an effective device for detecting efforts at tampering with information printed on the substrate. Such attempts may result in removal of the colored coating at the coating/substrate interface, revealing the white (in the case of most cellulosic substrates) substrate surface.

The dyes used may be encapsulated by conventional techniques. However, it is desirable that small capsule sizes of less than about 5.0 micrometers, and most preferably about 2.0 to 2.5 micrometers, be used. It has been found that the use of larger capsule sizes may result in removal of the dye onto fuser rolls in noncontact printing devices.

The coating further optionally includes a plasticizer which enhances the flexibility of the coating. Preferably, the plasticizer is one which can be dispersed in an aqueous solution, such as dibutyl phthalate. The plasticizer is added in an amount of less than about 10% by weight of the toner adhesion-enhancing composition (solids basis).

The toner adhesion enhancing composition of the present invention may be prepared as an aqueous dispersion containing from about 30 to about 50% solids, and preferably about 35 to about 45% solids. The aqueous dispersion has a relatively low viscosity which renders it readily printed or coated onto cellulosic web products by any of a number of conventional techniques.

Such coating techniques include, for example, printing by means of a flexographic press, offset gravure coating, direct blade coating, roll coating, and air knife coating. Further, the coating may be applied directly on a paper making machine to the cellulosic web such as by the use of gate roll, twin gate roll, blade, or bill blade coaters. The cellulosic web may be dried by heating or other conventional techniques after printing or coating of the toner adhesion-enhancing composition.

Additionally, the polymeric toner adhesion-enhancing coating of the present invention may be coated on one or both sides of the cellulosic web. Further, the toner adhesion-enhancing coating may be spot coated, by known techniques, onto predetermined portions of the cellulosic web product which are to receive toner. Because of the low viscosity of the aqueous solution of the coating composition, it may be readily printed as an ink would be in preselected locations on the web by flexographic printing techniques. Moderate heating of the web to temperatures of less than 150° F. is desirable to facilitate printing of the composition.

Once coated onto a cellulosic web, the toner adhesion-enhancing coating provides enhanced toner adhesion when the web is printed with a noncontact printing device such as a laser or xerographic imaging printer. Referring now to the single drawing Figure, the toner adhesion-enhancing coating of the present invention is illustrated in combination with other security features on a security document to aid in rendering that document more resistant to intentional alteration. Of course, the adhesion-enhancing coating also results in printing on the document which has increased resistance to removal during normal handling operations, both manual and automated. It has been found that the printing on documents coated with the toner adhesion-enhancing composition is more resistant to smudging, flaking, and blurring caused by handling.

As shown in the Figure, security document 20, in the form of a money order, has a line 21 for the identification of the payee as well as a line 23 for the identification of the payor or purchaser. Document 20 also has a place 25 for the insertion of a date when the document was prepared. Document 20 also includes an area 27 for the entry of the amount or value of the money order, and a place 29 where the same amount or value is spelled out in words. Finally, an area 31 is provided for entering the address of the payor or purchaser.

A number of security features are illustrated on document 20 which are more fully described in Mowry, U.S. Pat. No. 4,733,887, the disclosure of which is hereby incorporated by reference. The features include the use of special numeral fonts for the dollar 33 and cents 35 amounts, an automatic fill feature in the amount area using arrows and the words "Pay Only", cautionary messages such as "Not Valid over Five Hundred Dollars", and printing of the dollar and cents amounts using differing positive and negative outlines.

Additionally, document 20 may be printed on safety paper which has been chemically treated to provide evidence of any attempts at alteration. The toner adhesion-enhancing coating is shown in dotted outline as areas 40, 42, and 44 beneath the payee name 21, amount in words 29, and amount in numbers 33, 35. As previously described, the areas 40, 42, and 44 may be essentially colorless and thus not noticeable to the eye, or may be colored to highlight the areas.

In order that the invention may be more readily understood, reference is made to the following examples which are designed to illustrate the invention, but not limit the scope thereof.

EXAMPLE 1

A toner adhesion-enhancing composition in accordance with the present invention was prepared by mixing 8 gm of water with 4 ounces of a zinc oxide ammonia complex containing 15% zinc by weight and then adding that mixture to 100 gm of Joncryl 77 styrene-acrylic acid copolymer aqueous dispersion containing about 42% solids by weight. The resulting dispersion was stirred for two hours.

An encapsulated blue dye was prepared by encapsulating 54 gm Victoria Blue B concentrate, available from Keystone Color Company, with 164 gm of Suresol 290, available from Kock Chemical Company. as the capsule wall material. The capsules formed ranged in size from about 2.0 to 2.5 micrometers and had an overall solids content of 43%. The dye capsules were then added to the aqueous dispersion prepared above.

EXAMPLE 2

The toner adhesion-enhancing composition as prepared in Example 1 was applied to a 24# uncoated paper base stock web using a flexographic printing apparatus. The printing apparatus had an Anilox roll with a 165 line per inch quadragravure pattern. The coating weight applied was approximately 0.5 to 0.6 b/ream (17×22×500 sheet). The paper web was heated to a temperature of approximately 150° F. during coating. After drying, the coated web was rerolled.

EXAMPLE 3

The toner adhesion-enhancing composition of the present invention was tested for its effectiveness in bonding a fused toner image to coated paper stock as prepared in Example 2. For comparison, an uncoated 24# bond paper was also printed with a fused toner image and tested. The test was performed using a pressure sensitive adhesive tape (type 811, available for 3M Company) which was applied over the fused toner image using a 4 pound rubber roller and then immediately peeled away.

The amount of toner removed by the test was measured by comparing the density of the initial image with the density of the final image to provide an average density ratio (AvDR) defined as;

$$AvDR = \frac{\text{Initial Density}}{\text{Final Density}} \times 100$$

An Answer #2 densitometer was used to make the measurements, and a minimum test area of ¼ inch was used. The results are reported below.

| | Initial | Final | AvDr |
|---|---|---|---|
| Control sample (untreated) | 0.96 | 0.75 | 78.1 |

-continued

| | Initial | Final | AvDr |
|---|---|---|---|
| Sample w coating | 1.07 | 1.03 | 96.3 |

As can be seen, a marked improvement in toner retention is provided by the toner adhesion-enhancing coating of the present invention.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A toner adhesion-enhancing coated cellulosic product comprising a cellulosic web having first and second major surfaces, at least one of said major surfaces having coated thereon a polymeric toner adhesion-enhancing composition comprising a cross-linked copolymer formed from a mixture of a dispersion of a copolymer of styrene and acrylic acid having a glass transition temperature of between about −16 and 22 degrees C. and about 1 to about 5% by weight zinc as a cross-linking agent for said copolymer.

2. The coated product of claim 1 in which said toner adhesion-enhancing composition includes a coloring agent.

3. The coated product of claim 2 in which said coloring agent is a dye contained in a plurality of microcapsules.

4. The coated product of claim 3 in which said microcapsules are less than about 5.0 micrometers in diameter.

5. The coated product of claim 4 in which said microcapsules are between about 2.0 to about 2.5 micrometers in diameter.

6. The coated product of claim 1 in which said toner adhesion-enhancing composition is coated only on selected portions of said cellulosic web.

7. The coated product of claim 1 in which said toner adhesion-enhancing composition is applied at a coating weight of between about 0.3 and 1.0 lb/ream.

8. The coated product of claim 1 in which said coating further includes a plasticizer.

9. The coated product of claim 8 in which said plasticizer comprises a phthalate ester in an amount of less than about 10% by weight of said toner adhesion-enhancing composition.

10. A security document having enhanced toner adhesion characteristics for printing with a noncontact printing device comprising a cellulosic web having first and second major surfaces, at least one of said major surfaces having coated thereon a polymeric toner adhesion-enhancing composition comprising a cross-linked copolymer formed from a mixture of a dispersion of a copolymer of styrene and acrylic acid having a glass transition temperature of between about −16 and 22 degrees C. and about 1 to about 5% by weight zinc as a cross-linking agent for said copolymer.

11. The security document of claim 10 in which said toner adhesion-enhancing composition includes a coloring agent.

12. The security document of claim 11 in which said coloring agent is a dye contained in a plurality of microcapsules.

13. The security document of claim 12 in which said microcapsules are less than about 5.0 micrometers in diameter.

14. The security document of claim 13 in which said microcapsules are between about 2.0 to about 2.5 micrometers in diameter.

15. The security document of claim 10 in which said toner adhesion-enhancing composition is coated only on selected portions of said cellulosic web where MICR code, payee, and/or amount information is printed.

16. The security document of claim 10 in which said toner adhesion-enhancing composition is applied at a coating weight of between about 0.3 and 1.0 lb/ream.

17. The security document of claim 10 in which said coating further includes a plasticizer.

18. The security document of claim 17 in which said plasticizer comprises a phthalate ester in an amount of less than about 10% by weight of said toner adhesion-enhancing composition.

19. A method of printing a document using a noncontact printing device comprising the steps of forming a latent image of said document on an imaging drum, applying a toner to said latent image, transferring said latent image to a surface of a cellulosic web product having coated thereon a polymeric toner adhesion-enhancing composition comprising a mixture of a dispersion of copolymer of styrene and acrylic acid having a glass transition temperature of between about −16 and 22 degrees C. and about 1 to about 5% by weight zinc as a cross-linking agent for said copolymer, said adhesion-enhancing composition having been dried to form a cross-linked copolymer, and thereafter fusing said toner to said surface of said cellulosic product by the application of heat and pressure.

20. The method of claim 19 in which said toner adhesion-enhancing composition includes a coloring agent.

21. The method of claim 19 in which said toner adhesion-enhancing composition is coated only on selected portions of said cellulosic web where MICR code, payee, and/or amount information is printed.

22. The method of claim 19 in which said toner adhesion-enhancing composition is applied at a coating weight of between about 0.3 and 1.0 lb/ream.

23. The method of claim 19 in which said coating further includes a plasticizer.

24. The method of claim 23 in which said plasticizer comprises a phthalate ester in an amount of less than about 10% by weight of said toner adhesion-enhancing composition.

25. A method for making a toner adhesion-enhancing coated cellulosic product comprising a cellulosic web having first and second major surfaces, by coating on at least one of said major surfaces a polymeric toner adhesion-enhancing composition, wherein said adhesion-enhancing composition is formed by mixing an aqueous dispersion of a copolymer of styrene and acrylic acid having a glass transition temperature of between about −16 and 22 degrees C. with a zinc oxide ammonia cross-linking agent complex-contained in an aqueous alkaline solution, and drying said adhesion-enhancing composition which has been coated on said surface to form a cross-linked copolymer.

* * * * *